US008092873B2

(12) United States Patent
Wang et al.

(10) Patent No.: US 8,092,873 B2
(45) Date of Patent: Jan. 10, 2012

(54) PRINT MEDIUM FOR INKJET WEB PRESS PRINTING

(75) Inventors: Yongzhong Wang, Tucson, AZ (US); Kelly Ronk, San Diego, CA (US); Jason Swei, San Diego, CA (US); Sandeep Bangaru, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 266 days.

(21) Appl. No.: 12/609,639

(22) Filed: Oct. 30, 2009

(65) Prior Publication Data

US 2011/0104408 A1 May 5, 2011

(51) Int. Cl.
*B41M 5/00* (2006.01)

(52) U.S. Cl. ..... 428/32.21; 428/32.26; 428/32.28; 428/32.3; 428/32.34; 428/32.35; 427/243

(58) Field of Classification Search ..... 428/32.21, 428/32.26, 32.28, 32.3, 32.34, 32.35; 427/243
See application file for complete search history.

(56) References Cited

U.S. PATENT DOCUMENTS

| | | | | |
|---|---|---|---|---|
| 5,772,741 | A | 6/1998 | Spinelli | |
| 5,882,396 | A | 3/1999 | Hiorns | |
| 6,764,726 | B1 | 7/2004 | Yang et al. | |
| 7,018,708 | B2 | 3/2006 | Song et al. | |
| 7,176,248 | B2 | 2/2007 | Valentini et al. | |
| 2002/0056403 | A1 | 5/2002 | Johnson et al. | |
| 2002/0065339 | A1 | 5/2002 | Gore | |
| 2003/0081103 | A1 * | 5/2003 | Ishimaru et al. | 347/105 |
| 2003/0176566 | A1 | 9/2003 | Wight et al. | |
| 2003/0203133 | A1 * | 10/2003 | Maekawa | 428/32.1 |
| 2005/0170174 | A1 | 8/2005 | Windorski | |
| 2005/0260428 | A1 | 11/2005 | Song et al. | |
| 2006/0838722 | | 4/2006 | Sen et al. | |

FOREIGN PATENT DOCUMENTS

| | | |
|---|---|---|
| WO | 2009145762 | 12/2009 |

OTHER PUBLICATIONS

App No. PCT/US2009/039464 filed on Apr. 3, 2009.

* cited by examiner

*Primary Examiner* — Betelhem Shewareged

(57) ABSTRACT

A print medium suitable for inkjet web press printing is disclosed herein. The print medium includes a paper substrate and an ink-receiving layer coated onto at least one surface of the paper substrate. The ink-receiving layer includes: two different inorganic pigments with different particle sizes; a binder; a water-soluble metallic salt; and a colorant durability enhancer selected from the group consisting of boric acid, borax, sodium tetraborate, phenyl boronic acid, butyl boronic acid and combinations thereof.

13 Claims, No Drawings

PRINT MEDIUM FOR INKJET WEB PRESS PRINTING

BACKGROUND

High speed inkjet web press printing is a commercial printing technology developed to print on a continuous paper web at rates of hundreds of feet per minute. Printing is done on continuous-web printing presses. The paper web, which is a continuous roll of paper, is conveyed along a paper path that includes stationary inkjet printheads for ejecting a series of ink droplets onto the web. The paper web then goes through a drying oven, and subsequently, through rollers to be rewound. If the ink on the paper does not dry quickly, the printed images are smeared. The present disclosure relates generally to coated print media that are particularly suitable for such high speed web press printing.

DETAILED DESCRIPTION

In inkjet printing, aqueous inks containing a large amount of water are conventionally used. The colorants in aqueous inks include water-soluble dyes or water-dispersible pigments. Thus, the colorants in the aqueous inks are quite hydrophilic. One challenge in printing textbooks with inkjet web press printing relates to the issue of highlighter smear. "Highlighter smear" refers to smearing of a printed image when the printed image is marked with a highlighter pen. Textbooks are frequently high-lighted to accentuate key information or text. Most highlighters contain yellow dye or other color dyes dissolved in liquid such as water and organic solvents. When printed books are high-lighted, water and organic solvents from the highlighter contact the colorants on the printed paper. Smearing of the colorants occurs when the bonding of the colorants to the paper is weakened by the water and organic solvents in the highlighter. Images and text printed on conventional inkjet media using inkjet web presses are susceptible to this highlighter smearing problem.

Media coated with a thin layer of silica-based coating have often been used to achieve reduced print bleed and strike-through. Such media, which usually have a matte finish, can be used in various inkjet printing systems, including large scale jobs on an inkjet web press system. However, such media are relatively expensive. For printing limited edition brochures, for example, the matte finished, silica-based coatings can be an appropriate choice for an inkjet web press system. However, in more extensive print jobs in which price is more of a limiting factor, such as printing textbooks, silica-based coatings would usually be considered too expensive.

Text books have been traditionally printed by using offset printing presses (either sheet-fed or web-fed printing presses). Oil-based inks are normally used for offset printing because they provide good smear resistance. However, offset printing presses are not economical for printing limited amount of books due to the need of printing plates. High-speed digital printing using of printing presses such as inkjet web presses can reduce the number of steps required by offset printing, thereby making printing a small amount of books more efficient and more economical. However, when conventional low weight, coated offset papers with high glossy finish are used in inkjet web based systems, they tend to produce poor image quality. More specifically, they tend to have poor mottle and bleed characteristics and slow drying characteristics.

The present disclosure provides an improved inkjet print medium that works well for high-speed, inkjet web press printing. An important aspect of the media of the present disclosure is that this media shows marked improvement in highlighter smear resistance in addition to improvements in ink absorption, wet-wipe resistance and in reducing ink bleed. The novel print medium includes a paper substrate and an ink-receiving layer on one or both sides of the paper substrate. The improvements are the result of a specific combination of components in the ink-receiving layer, which includes at least two inorganic pigments with different average particle sizes, a binder, and a boron-containing colorant durability enhancer. In another embodiment, the ink-receiving layer further includes a metallic salt. The "ink-receiving layer" as used herein refers to the outermost layer which receives the ink droplets during printing and on which a printed image is formed. The improved print medium of the present disclosure will now be described in further detail below.

Paper Substrate

The paper substrate of the improved media is a paper base containing cellulose fibers. More specifically, the paper base may be produced from chemical pulp, mechanical pulp, thermal mechanical pulp and/or the combination of chemical and mechanical pulp. In one embodiment, the opacity of the paper is 70% or more. In another embodiment, the opacity of the paper is greater than 80%. In one embodiment, the TAPPI brightness of the paper is 70 or more (as measured using TAPPI test method). In yet another embodiment, the brightness of the paper is greater than 80. The paper substrate may have a basis weight ranging from 30 to 250 g/m$^2$, although basis weight outside of this range is possible if desired. The paper substrate may also include other conventional additives such as internal sizing agents and fillers. The internal agents are added to the pulp before it is converted into a paper web or substrate. They may be chosen from conventional internal sizing agents for inkjet papers. The paper base may contain fillers in an amount of about 5% to about 30% by weight. The fillers may be any particular types used in conventional paper making. As a non-limiting example, the fillers may be selected from calcium carbonate, talc, clay, kaolin, titanium dioxide and combinations thereof.

Ink-Receiving Layer

The ink-receiving layer of the improved print medium is a coating layer formed by applying a coating composition directly onto an uncoated paper base described above or a pre-coated paper base (i.e., a paper base coated with one or more intermediate coatings). The inorganic pigments in the ink-receiving layer include a first inorganic pigment has an average particle size of 1.0 micron or larger (herein after referred to as "larger inorganic pigment"). The second pigment has an average particle size of 0.5 micron or smaller (herein after referred to as "smaller inorganic pigment"). The amount of larger pigment in the ink-receiving layer is at least 22 wt. % based on the dry weight of pigments in total, preferably 22 wt. % to 99 wt. %, more preferably 40 wt. % to 80 wt. %. The amount of smaller pigment in the ink-receiving layer is in the range of 1 wt. % to 78 wt. % based on the dry weight of pigments in total, preferably 20 wt. % to 60 wt. %. The total amount of inorganic pigments in the ink-receiving layer is in the range of 60 wt. % to 90 wt. % based on the total dry weight of the ink receptive layer. "Wt. %" as used herein refers to dry weight percentage. The larger pigment in the ink-receiving layer is composed of pigment particles of calcined clay or silica, or combination thereof. The smaller pigment in the ink receptive layer is composed of pigment particles of kaolin clay or calcium carbonate (precipitated or ground), or combination thereof.

The binder used for the ink-receiving layer is selected from water-based binders. Water-based binders include polymer solutions, polymer dispersions and polymer lattices. Suitable binder polymers include polyvinyl alcohol, styrene-butadiene, acrylonitrile-butadiene, styrene-butyl acrylate, acrylic, vinyl acetate, vinylidene chloride, polyester, polyvinylpyrrolidone, copolymers or combinations thereof. Natural water-soluble binders may also be used and include starch, such as oxidized starch, cationized starch, esterified starch, enzymatically denatured starch and the like, gelatin, casein, soybean protein, cellulose derivatives such as carboxy-methyl cellulose, hydroxyethyl cellulose and the like. The amount of the binder in the ink-receiving layer ranges from about 4 wt. % to about 30 wt. % based on the total weight of the ink-receiving layer, preferably about 5 wt. % to about 15 wt. %.

The colorant durability enhancer used in the ink-receiving layer includes boric acid, borax, sodium tetraborate, phenyl boronic acid, butyl boronic acid or combinations thereof. Such colorant durability enhancer serves well to enhance the colorant durability in inkjet inks on the media for better wet wipe resistance and better highlighter smear resistance. The function of the boron-containing colorant durability enhancer as a colorant durability enhancer is separate from its cross-linking function. This is evidenced by the fact that cross-linking of the ink-receiving layer with other cross-linking agents such as glyoxal did not show improved colorant durability. According to a preferred embodiment, the colorant durability enhancer is selected from the group consisting of boric acid, borax, sodium tetraborate, phenyl boronic acid, butyl boronic acid, and combinations thereof. It is found that the boron-containing compound is more effective as color durability enhancer within a certain range. The more effective range is from about 0.1 wt. % to about 20 wt. % based on the dry weight of the binder.

Some inks used in inkjet web press printing processes are aqueous pigment inks. Pigment inks usually have better longevity (better light fade resistance) than dye inks. Accordingly, pigment inks are preferred for printing on coated and un-coated papers. When pigment inks are printed on papers, especially on coated papers, the inks are settled on the surface of the paper coatings. The inks can be partially rubbed off if rubbed by the adjacent paper sheet. In a printed book, the ink rub-off can result in a loss of color density on the printed page as well as color transfer onto the adjacent page.

The metallic salt in the ink-receiving layer of the present disclosure functions as a colorant fixing agent for fixing the color pigments in the ink onto the surface of the media being printed. Suitable metallic salts include water-soluble monovalent or polyvalent metallic salts having cations selected from Group I metals, Group II metals, Group III metals, or transitional metals, such as sodium, calcium, copper, nickel, magnesium, zinc, barium, iron, aluminum, and chromium ions, and combinations thereof. The anions for the metallic salts may be selected from the group consisting of chloride, iodide, bromide, nitrate, sulfate, sulfite, phosphate, chlorate, acetate ions, or various combinations thereof. In one embodiment, the metallic salt is present in an amount ranges from about 1 wt. % to about 25 wt. % based on the total weight of the ink-receiving layer.

Optionally, the ink-receiving layer may include a coefficient of friction (COF) reducer such as include polyethylene wax, paraffin wax, carnauba wax, polypropylene wax, polytetrafluoroethylene wax or various combinations thereof. This wax material is incorporated into the ink-receiving coating composition as an emulsion of fine wax particles. In one embodiment, the fine wax particles have particle sizes in the range from 0.1 to 2.0 microns. The COF reducer is present in an amount from about 0.5 wt. % to about 5 wt. % based on the dry weight of the ink-receiving layer.

Optional coating additives, such as wetting agents, defoaming agents, anti-foaming agents and dispersing agents, may also be incorporated into the ink-receiving layer to improve the ink-receiving layer's properties and the application of this layer onto the paper substrate by various coating methods. These additives may be present in an amount ranging from about 0.2% to about 5% by weight based on the dry weight of the ink receptive layer.

Coating Methods for Forming the Ink-Receiving Layer

The coating methods for applying the ink-receiving coating composition onto the paper substrate include size press, slot die, curtain coating, blade coating and Meyer rod. The size presses include puddle-sized press, film-sized press and the like. The puddle-sized press may be configured as having horizontal, vertical, or inclined rollers. The film-sized press may include a metering system, such as gate-roll metering, blade metering, Meyer rod metering, or slot metering. For some embodiments, a film-sized press with short-dwell blade metering may be used as an application head to apply a coating solution. In another embodiment, a film-sized press is used to apply the coating composition to a paper substrate. The coating composition for forming the ink-receiving layer (hereafter referred to as "ink-receiving coating composition") can be applied to the paper substrate off-line or in-line of a paper-making machine. In yet another embodiment, the ink receptive coating composition is applied to the paper substrate by a size press on-line during the surface sizing stage while the paper is being manufactured on a paper machine. One of the main purposes of surface sizing is to add chemicals to the paper fibers in order to improve paper surface strength (low dusting). In general, surface sizing improves paper properties by reinforcing the bonds of fibers with a water-soluble binding agent (usually starch). The coating weight of the applied surface sizing materials is usually low (in the range of 0.2 to 10 grams per square meter per side).

In an embodiment of the present disclosure, the ink receptive coating composition may be applied to a paper substrate with or without other conventional surface sizing chemicals such as starch. In one embodiment, the ink receptive coating composition is applied to a paper substrate without surface sizing chemicals, by using a size press of a paper machine. In this case, the ink receptive coating composition is replacing the conventional surface sizing solution in the paper making process. Thus, the ink receptive coating composition may be applied to a paper substrate during the surface sizing stage through a size press of a paper machine. In an alternative embodiment, the ink receptive coating composition is applied to the paper substrate by means of a coating machine. As an example, the ink receptive coating composition is applied to a paper substrate by a blade coater.

In yet another embodiment, the paper base may be pre-coated with a clay coating in the paper mill during the paper-making process to make the paper base more receptive to the ink-receiving layer, and then the pre-coated paper base is coated with the novel ink-receiving coating composition of the present disclosure.

The ink-receiving layer may be formed on one or both surfaces of a paper substrate and may have a coating weight of 1 to 25 grams per square meter ($g/m^2$) per side. In one embodiment, the coating weight ranges from 4 to 15 $g/m^2$. A calendaring process may be performed after the ink-receiving coating has been dried to improve surface smoothness and gloss. The calendaring process may include super calendar or soft calendar. In one embodiment, the on-line soft calendar in the papermaking machine is used to achieve the smoothness and gloss target.

The following Examples will serve to illustrate representative embodiments and should not be construed as limiting of the disclosure in any way. All parts referred to herein are by weight unless otherwise indicated.

EXAMPLES

Example 1

Ten ink-receiving coating compositions, Formulations 1-10, were prepared according to the following formulations:

Formulation 1

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 16.09 parts |
| Kaocal (powder)[3] | 17.42 parts |
| Calcium chloride solution (32% solid) | 6.75 parts |
| Boric acid solution (4%) | 18.00 parts |
| Water | balance |

[1]polyol polyester blend supplied by Performance Process Inc.

[2]kaolin clay supplied by BASF Corporation.

[3]calcined clay supplied by Thiele Kaolin Company.

Formulation 2

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 20.49 parts |
| Kaocal (powder)[3] | 14.34 parts |
| Calcium chloride solution (32% solid) | 6.75 parts |
| Boric acid solution (4%) | 18.00 parts |
| Water | balance |

[1],[2],[3]as described for Formula 1

Formula 3

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 24.89 parts |
| Kaocal (powder)[3] | 11.26 parts |
| Calcium chloride solution (32% solid) | 6.75 parts |
| Boric acid solution (4%) | 18.00 parts |
| Water | balance |

[1],[2],[3]as described for Formula 1

Formula 4

| | |
|---|---|
| Polyvinyl alcohol solution (19%) (Mowiol 4-98) | 22.74 parts |
| Defoaming agent (AC-22)[1] | 0.12 parts |
| Covergloss (70% solid)[2] | 16.09 parts |
| Kaocal (powder)[3] | 17.42 parts |
| Calcium chloride solution (32% solid) | 6.75 parts |
| Boric acid solution (4%) | 18.00 parts |
| Water | balance |

[2]kaolin clay supplied by J. M. Huber Corporation.

[1],[3]as described for Formula 1.

Formula 5

| | |
|---|---|
| Polyvinyl alcohol solution (19%) (Mowiol 4-98) | 22.74 parts |
| Defoaming agent (AC-22)[1] | 0.12 parts |
| Covergloss (70% solid)[2] | 16.09 parts |
| Ansilex 93 (powder)[3] | 17.42 parts |
| Calcium chloride solution (32% solid) | 6.75 parts |
| Boric acid solution (4%) | 18.00 parts |
| Water | balance |

[1]as described for Formula 1

[2]as described for Formula 4

[3]calcined clay supplied by BASF Corporation

Formula 6

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 16.09 parts |
| Ansilex 93 (powder)[3] | 17.42 parts |
| Calcium chloride solution (32% solid) | 6.75 parts |
| Boric acid solution (4%) | 18.00 parts |
| Water | balance |

[1],[2]as described for Formula 1

[3]as described for Formula 6

Formula 7

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 15.89 parts |
| Kaocal (powder)[3] | 17.20 parts |
| Ultralube E-846[4] (as COF reducer) | 0.90 parts |
| Calcium chloride solution (32% solid) | 6.75 parts |
| Boric acid solution (4%) | 18.00 parts |
| Water | balance |

[1],[2],[3]as described for Formula 1.

[4]polyethylene wax supplied by KEIM-ADDITEC Surface USA, LLC

Formula 8

| | |
|---|---|
| Polyvinyl alcohol solution (19%) (Mowiol 4-98) | 17.05 parts |
| Defoaming agent (AC-22)[1] | 0.12 parts |
| Ultragloss 90 (70% solid)[2] | 16.51 parts |
| Kaocal (powder)[3] | 17.84 parts |
| Ultralube E-846[4] (as COF reducer) | 0.90 parts |
| Calcium chloride solution (32% solid) | 6.75 parts |
| Boric acid solution (4%) | 18.00 parts |
| Water | 22.82 parts |

[1],[2],[3]as described in EXAMPLE 1.

[4]as described in Example 7

Formula 9

| | |
|---|---|
| Polyvinyl alcohol solution (19%) (Mowiol 4-98) | 11.37 parts |
| Defoaming agent (AC-22)[1] | 0.12 parts |
| Ultragloss 90 (70% solid)[2] | 17.41 parts |
| Kaocal (powder)[3] | 18.29 parts |
| Ultralube E-846[4] (as COF reducer) | 0.90 parts |
| Calcium chloride solution (32% solid) | 6.75 parts |
| Boric acid solution (4%) | 18.00 parts |
| Water | balance |

[1],[2],[3]as described for Formula 1

[4]as described for Formula 7

Formula 10

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 16.09 parts |
| Gasil IJ624 (powder)[3] | 17.42 parts |
| Calcium chloride solution (32% solid) | 6.75 parts |
| Boric acid solution (4%) | 18.00 parts |
| Water | balance |

[1],[2]as described for Formula 1

[3]silica powder supplied by PQ corporation

Each coating composition was applied with a laboratory blade coater onto a 32.8# (basis weight of about 49.2 g/m$^2$) chemical pulp-based plain paper and dried with a dryer to form a coating layer. The coat weight of the coating layer was about 7 g/m$^2$. The dried paper was then calendared at 2500 pound per square inch (psi) at room temperature on a laboratory calendar machine.

Highlighter Smear Test

Each of the coated paper samples in Example 1 was printed with lines using an inkjet printer with pigment-based inks and air dried at room temperature for 24 hours after printing. A Faber-Castell® highlighter was mounted on an automatic machine to highlight the lines (twice across the line direction) to see how much ink was smeared from the printed lines. The colorants from the lines were partially smeared and transferred to the un-printed area. The optical density of the colorants in this un-printed area was measured as units of mOD (1 mOD=1000$^{th}$ Optical Density) with an X-rite 938 spectrodensitometer. The lower smear mOD value represents higher smear resistance for the coated paper. Generally, the smear mOD value of 50 or higher is considered to be not acceptable because the smear makes the printed text less legible.

Example 2

Comparative Coatings

For comparison, Comparative compositions 1-4 were prepared according to the following formulations:

Comparative Composition 1

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 32.77 parts |
| Kaocal (powder)[3] | 5.74 parts |
| Calcium chloride solution (32% solid) | 6.75 parts |
| Boric acid solution (4%) | 18.00 parts |
| Water | balance |

[1],[2],[3]as described for Formula 1

Comparative Composition 2

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 16.09 parts |
| Nuclay (67% solid)[3] | 26.00 parts |
| Calcium chloride solution (32% solid) | 6.75 parts |
| Boric acid solution (4%) | 18.00 parts |
| Water | balance |

[1],[2]as described for Formula 1

[3]kaolin clay supplied by BASF Corporation

Comparative Composition 3

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 16.09 parts |
| Hydramatte (powder)[3] | 17.42 parts |
| Calcium chloride solution (32% solid) | 6.75 parts |
| Boric acid solution (4%) | 18.00 parts |
| Water | balance |

[1],[2]as described for Formula 1

[3]kaolin clay supplied by J. M. Huber Corporation

Comparative Composition 4

| | |
|---|---|
| Polyvinyl alcohol solution (19%) (Mowiol 4-98) | 22.74 parts |
| Defoaming agent (AC-22)[1] | 0.12 parts |
| Ultragloss 90 (70% solid)[2] | 16.09 parts |
| Orisil 150 (powder)[3] | 17.42 parts |
| Calcium chloride solution (32% solid) | 6.75 parts |
| Boric acid solution (4%) | 18.00 parts |
| Water | balance |

[1],[2]as described for Formula 1

[3]silica powder supplied by Orisil LTD, Ukraine.

Using the procedures of Example 1, each of the Comparative compositions 1-4 was applied onto a 32.8# chemical pulp-based plain paper and dried with a dryer to form a coating layer having a coat weight of about 7 g/m$^2$. The dried paper was then calendared at 2500 pound per square inch (psi) at room temperature on a laboratory calendar machine.

The comparative coated paper samples were subjected to the same highlighter smear test as described in Example 1.

Particle Size Test

The particle size of the inorganic pigments used in Formulas 1-10 and Comparative compositions 1-4 was measured with a Zetasizer Nano ZS from Malvern Instruments Limited. The type of inorganic pigments used and the average particle sizes (Z-average) are summarized in Table 1.

TABLE 1

Pigment Particle Type and Size

| Pigment | Pigment Type | Particle Size (micron) |
|---|---|---|
| Ultragloss 90 | Kaolin Clay | 0.35 |
| Kaocal | Calcined Clay | 1.40 |
| Covergloss | Kaolin Clay | 0.35 |
| Ansilex 93 | Calcined Clay | 1.20 |
| Nuclay | Kaolin Clay | 0.49 |
| Hydramatte | Kaolin Clay | 0.50 |
| Gasil IJ624 | Silica | 5.50 |
| Orisil 150 | Silica | 0.29 |

The relative particle sizes, the weight ratio of larger pigment to smaller pigment ratio (based on dry weight of the total pigments) and highlighter smear test results for all of the coated paper samples prepared in Examples 1 and 2 are summarized in Table 2.

TABLE 2

| | Larger Pigment | | Smaller Pigment | | | | Highlighter |
|---|---|---|---|---|---|---|---|
| | Type | Size (micron) | Type | Size (micron) | Pigment Ratio* | Ultralube | smear (mOD) |
| Formula 1 | Kaocal | 1.40 | Ultragloss 90 | 0.35 | 60/40 | No | 34 |
| Formula 2 | Kaocal | 1.40 | Ultragloss 90 | 0.35 | 50/50 | No | 39 |
| Formula 3 | Kaocal | 1.40 | Ultragloss 90 | 0.35 | 40/60 | No | 41 |
| Formula 4 | Kaocal | 1.40 | Covergloss | 0.35 | 60/40 | No | 25 |
| Formula 5 | Ansilex 93 | 1.20 | Covergloss | 0.35 | 60/40 | No | 31 |
| Formula 6 | Ansilex 93 | 1.20 | Ultragloss 90 | 0.35 | 60/40 | No | 45 |
| Formula 7 | Kaocal | 1.40 | Ultragloss 90 | 0.35 | 60/40 | Yes | 22 |
| Formula 8 | Kaocal | 1.40 | Ultragloss 90 | 0.35 | 60/40 | Yes | 35 |
| Formula 9 | Kaocal | 1.40 | Ultragloss 90 | 0.35 | 60/40 | Yes | 34 |
| Formula 10 | Gasil IJ624 | 5.50 | Ultragloss 90 | 0.35 | 60/40 | No | 34 |
| Comparative 1 | Kaocal | 1.40 | Ultragloss 90 | 0.35 | 20/80 | No | 54 |
| Comparative 2 | Nuclay | 0.49 | Ultragloss 90 | 0.35 | 60/40 | No | 52 |
| Comparative 3 | Hydramatte | 0.50 | Ultragloss 90 | 0.35 | 60/40 | No | 50 |
| Comparative 4 | Ultragloss 90 | 0.35 | Orisil 150 | 0.29 | 40/60 | No | 52 |

Note:
Pigment Ratio* is the ratio of larger pigment to smaller pigment based on dry weight of the total pigments.

The results in Table 2 show that the ink-receiving layers based on Formulas 1-10, which represent the novel coating compositions of the present disclosure, yielded good highlighter smear resistance (<50 mOD) after printing as compared to coatings based on Comparative compositions 1-5. The ink-receiving layers formed from the Comparative compositions all contain pigments with particle size less than 0.5 microns.

Comparative composition 1 has a larger pigment to smaller pigment ratio of 20/80 based on the dry weight of total pigments. Comparative composition 2 has a larger pigment to smaller pigment ratio of 60/40 based on the dry weight of total pigments in the ink receptive layer, but the larger pigment only has an average particle size of 0.49 microns. The Comparative composition 3 has a larger pigment to smaller pigment ratio of 60/40 based on the dry weight of total pigments, the larger pigment only has a particle size of 0.50 microns.

Comparative composition 4 is similar in composition to Formula 10; however, the silica particle size in Comparative composition 4 (0.29 micron) is much smaller than the silica particle size in Formula 10. As a result, the ink-receiving layer based on Comparative composition 4 did not yield good highlighter smear resistance.

While several embodiments have been described in detail, it will be apparent to those skilled in the art that the disclosed embodiments may be modified. Therefore, the foregoing description is to be considered exemplary rather than limiting.

What is claimed is:

1. A coated print medium for inkjet web press printing comprising:

a paper substrate comprising cellulose fibers;

an ink-receiving layer coated on at least one surface of the paper substrate, said ink receiving-layer comprising:

about 60 wt. % to about 90 wt. % of inorganic pigments based on the total weight of the ink-receiving layer;

at least one binder;

a water-soluble metallic salt; and a colorant durability enhancer selected from the group consisting of boric acid, borax, sodium tetraborate, phenyl boronic acid, butyl boronic acid and combinations thereof, wherein said inorganic pigments include a larger pigment having an average particle size of 1.0 micron or larger and selected from the group consisting of calcined clay, silica and combination thereof, and a smaller pigment having an average particle size of 0.5 micron or smaller and selected from the group consisting of kaolin clay, calcium carbonate and combination thereof, and wherein the larger pigment is present in an amount ranging from 22 wt. % to 99 wt. % based on the dry weight of inorganic pigments in total, and the smaller pigment is present in an amount ranging from 1 wt. % to 78 wt. % based on the dry weight of inorganic pigments in total.

2. The coated print medium of claim 1, wherein the larger pigment is present in an amount ranging from 40 wt. % to 80 wt. % based on the dry weight of inorganic pigments in total, and the smaller pigment is present in an amount ranging from 20 wt. % to 60 wt. % based on the dry weight of inorganic pigments in total.

3. The coated print medium of claim 1, wherein the ink-receiving layer comprises:

about 4 wt. % to about 30 wt. % of at least one binder based on the total weight of the ink-receiving layer;

about 1 wt. % to about 25 wt. % of a water-soluble metallic salt based on the total weight of the ink-receiving layer; and about 0.1 wt. % to about 20 wt. % of a colorant durability enhancer based on the dry weight of the binder.

4. The coated print medium of claim 1, wherein the ink-receiving layer further comprises a coefficient of friction (COF) reducer selected from the group consisting of polyethylene wax, paraffin wax, carnauba wax, polypropylene wax, polytetrafluoroethylene wax, and combinations thereof.

5. The coated print medium of claim 4, wherein the COF reducer is present in an amount ranging from about 0.5 wt. % to about 5.0 wt. % based on the total weight of the ink-receiving layer.

6. The coated print medium of claim 1, wherein said at least one binder is selected from the group consisting of polyvinyl alcohol, styrene-butadiene, acrylonitrile-butadiene, and combinations thereof.

7. The coated print medium of claim 1, wherein said water-soluble metallic salt is a mono-valent or multi-valent metallic salt having metal cation selected from the group consisting of Group I metals, Group II metals, Group III metals, transitional metals, and combinations thereof, and anion selected from the group consisting of chloride, iodide, bromide, nitrate, sulfate, sulfite, phosphate, chlorate, acetate, and combinations thereof.

8. A method for forming a print medium for inkjet web press printing comprising:

(a) preparing a coating composition comprising:
two different inorganic pigments having different average particle sizes;
at least one water-based binder;
a water-soluble metallic salt;
a boron-containing compound selected from the group consisting of boric acid, borax, sodium tetraborate, phenyl boronic acid, butyl boronic acid and combinations thereof;

(b) applying the coating composition to at least one surface of a paper substrate; and (c) drying the coated paper substrate to form an ink-receiving layer on the paper substrate, wherein said two different inorganic pigments include a larger pigment having an average particle size of 1.0 micron or larger and selected from the group consisting of calcined clay, silica and combination thereof, and a smaller pigment having an average particle size of 0.5 micron or smaller and selected from the group consisting of kaolin clay, calcium carbonate and combination thereof, and wherein the larger pigment is present in an amount ranging from 22 wt. % to 99 wt. % based on the dry weight of inorganic pigments in total, and the smaller pigment is present in an amount ranging from 1 wt. % to 78 wt. % based on the dry weight of inorganic pigments in total.

9. The method of claim 8 further comprising calendaring the coated paper substrate after drying.

10. The method of claim 8 further comprises mixing into the coating composition an emulsion of wax particles selected from the group consisting of polyethylene wax particles, paraffin wax particles, carnauba wax particles, polypropylene wax particles, polytetrafluoroethylene wax particles, and combinations thereof.

11. The method of claim 8, wherein the larger pigment is present in an amount ranging from 40 wt. % to 80 wt. % based on the dry weight of inorganic pigments in total, and the smaller pigment is present in an amount ranging from 20 wt. % to 60 wt. % based on the dry weight of inorganic pigments in total.

12. The method of claim 8, wherein said at least one water-based binder is selected from the group consisting of polyvinyl alcohol, styrene-butadiene, acrylonitrile-butadiene, and combinations thereof.

13. The method of claim 9, wherein said water-soluble metallic salt is a mono-valent or multi-valent metallic salt having metal cation selected from the group consisting of Group I metals, Group II metals, Group III metals, transitional metals, and combinations thereof, and anion selected from the group consisting of chloride, iodide, bromide, nitrate, sulfate, sulfite, phosphate, chlorate, acetate, and combinations thereof.

* * * * *